United States Patent [19]

Horowitz

[11] 4,278,226

[45] Jul. 14, 1981

[54] ELECTRICAL CONNECTOR MOUNTING BRACKET

[75] Inventor: Charles Horowitz, Niles, Ill.

[73] Assignee: Sloan Valve Company, Franklin Park, Ill.

[21] Appl. No.: 63,680

[22] Filed: Aug. 6, 1979

[51] Int. Cl.[3] ..... A47F 5/00

[52] U.S. Cl. ..... 248/314; 248/65; 280/42

[58] Field of Search ..... 248/314, 316 R, 316 F, 248/315, 75, 65, 309; 339/93, 125, 38, 36; 280/421

[56] References Cited

U.S. PATENT DOCUMENTS

| | | | |
|---|---|---|---|
| 2,320,397 | 6/1943 | Ross | 248/75 |
| 2,747,822 | 5/1956 | Allen et al. | 248/314 X |
| 2,943,138 | 6/1960 | Reager | 248/65 X |
| 3,096,960 | 7/1963 | Kinney | 248/314 X |
| 3,176,257 | 3/1965 | Introvigne | 280/421 X |
| 3,293,528 | 12/1966 | Rosen et al. | 248/309 X |
| 3,482,203 | 12/1969 | Whitright | 248/314 X |
| 3,672,617 | 6/1972 | Neyendorf | 248/75 |

*Primary Examiner*—J. Franklin Foss

*Attorney, Agent, or Firm*—Kinzer, Plyer, Dorn & McEachran

[57] ABSTRACT

A holder for an electrical connector of the tractor-trailer type includes a bracket for use in attaching the holder to the tractor with the bracket having an opening of a size and shape to receive an aligned connector body and key. A coil spring is attached to the bracket coaxial with the opening and a cap is carried by the spring in position to cover an inserted connector body. There are locking means on the bracket which cooperate with the key to hold the connector body within the holder.

6 Claims, 5 Drawing Figures

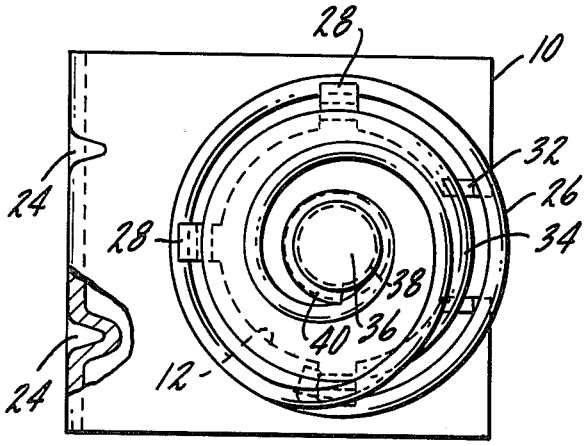
fig.1.
fig.2.
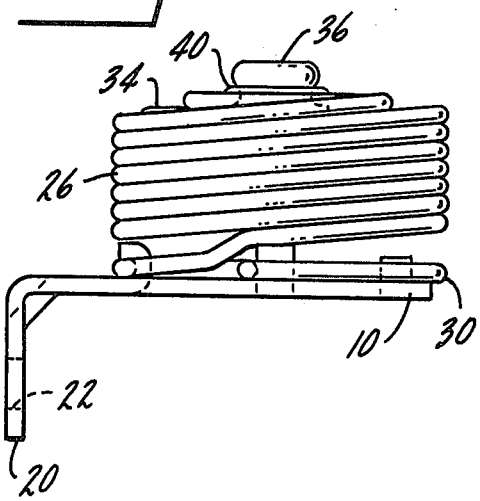
fig.3.
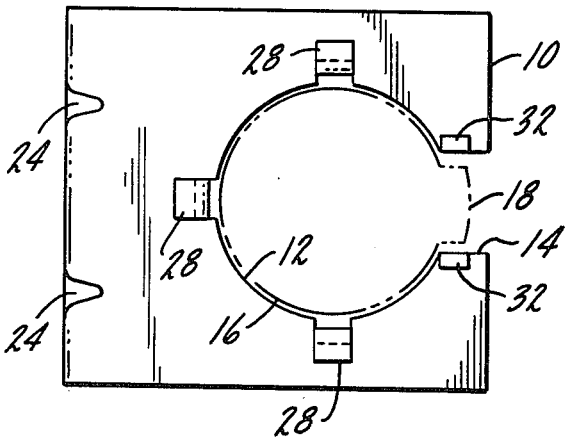
fig.5.
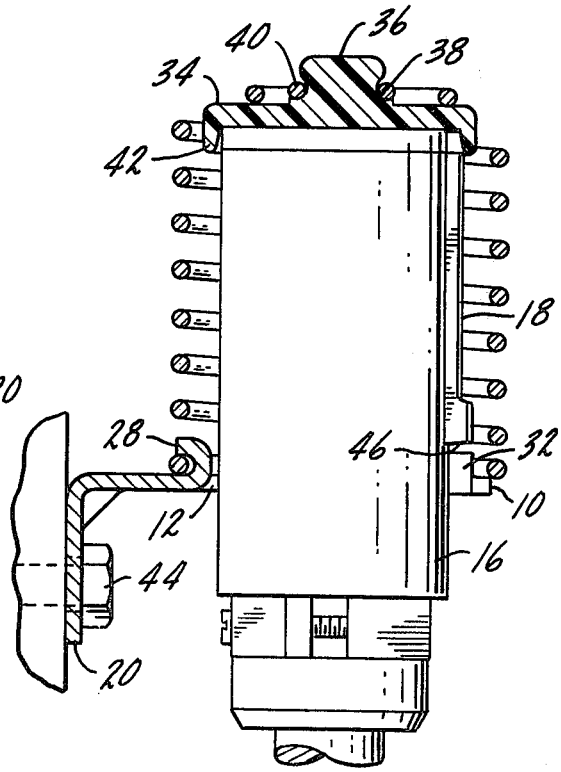
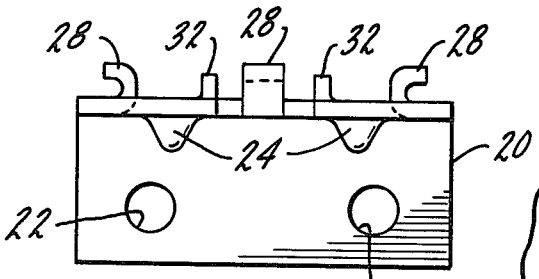
fig.4.

ELECTRICAL CONNECTOR MOUNTING BRACKET

SUMMARY OF THE INVENTION

The present invention relates to holders for use in supporting the unconnected connector body of a tractor-trailer electrical cable.

A primary purpose is a simply-constructed reliably operable connector holder of the type described.

Another purpose is a connector holder having a cap to cover the exposed end of an inserted connector.

Another purpose is a connector holder of the type described having a minimum number of parts.

Another purpose is a connector holder which consists essentially of a bracket, spring and cap.

Other purposes will appear in the ensuing specification, drawings and claims.

BRIEF DESCRIPTION OF THE DRAWINGS

The invention is illustrated diagrammatically in the following drawings wherein:

FIG. 1 is a top view of the connector holder disclosed herein,

FIG. 2 is a side view of the holder of FIG. 1,

FIG. 3 is a top view of the bracket with a connector body shown in broken lines, FIG. 4 is an end view of the bracket, and FIG. 5 is a side view of the holder with a connector body inserted therein.

DESCRIPTION OF THE PREFERRED EMBODIMENT

U.S. Pat. No. 3,176,257 shows an electrical connector holder of the general type disclosed herein. However, the present structure is of a more simplified nature and has substantially fewer parts.

When a tractor-trailer combination is separated the "trailer-plug" end of the electrical cable connecting the two units, such as shown in U.S. Pat. No. 4,106,834, is normally supported on the back of the tractor cab. Disclosed herein is an improved holder for the cylindrical body forming the trailer plug.

The holder includes a bracket 10 having an opening 12 generally circular in shape with a keyway 14 at one side. As shown in phantom outline in FIG. 3, the cylindrical body 16 of the connector is closely sized to opening 12 and it has an exterior axially-extending key 18 formed to pass through keyway 14 when the connector is inserted.

Bracket 10 has a right angle flange 20 with mounting openings 22 and there may be integral reinforcement fillets 24 between the flange and the main portion of the bracket.

A coil spring 26 is attached to bracket 10 coaxial with opening 12 by means of mounting tabs 28. There may be three such tabs, each integral with the bracket and generally uniformly spaced about opening 12. Each of tabs 28, as particularly shown in FIG. 2, extend over the lowest coil 30 of spring 26.

As particularly shown in FIGS. 3 and 4, pilot members 32 extend away from bracket 10 on opposite sides of keyway 14. Pilot members 32, which may be integral with the bracket, are used both in maintaining alignment of the spring with the bracket and for locking the connector body in the holder for preventing accidental removal of the connector, once inserted.

A cap 34 is positioned within and attached to coil spring 26. The cap has a small centrally located button 36 defining a slight groove 38 which receives a spring coil 40 of substantially reduced diameter which is wrapped around the bottom to attach the cap to the spring. Cap 34 has a peripheral flange 42 which extends toward bracket 10 and will enclose the end of an inserted connector body as shown in FIG. 5.

In use the bracket will be attached to a convenient portion of the rear of the tractor cab facing the trailer by bolts or the like 44, as shown in FIG. 5. When the trailer plug end of the electrical cable connecting the tractor and trailer is not in use, it is positioned within the holder. First cylindrical body 16 and exterior axial key 18 are aligned with opening 12 and keyway 14. As the connector is pushed inwardly against the force of spring 26 its inner end is held by flange 42 of the cap. The connector body is pushed inwardly until the end 46 of key 18 is beyond pilot members 32 after which the connector body may be twisted, either right or left, until the key is circumferentially beyond the appropriate pilot member. Spring 26 will, upon release of the connector body, then force it back toward bracket 10 with key end 46 resting upon the bracket upper surface. Once in the fully locked position described above, the connector body cannot be removed without first being pushed inwardly until the key clears the pilot members. Thus, an accidential turning of the connector while in the holder will not cause it to be released by the holder.

Cap 34 not only covers the open end of the connector preventing moisture, dust and dirt from reaching the electrical contacts, but also assists in aligning the connector body during insertion.

The holder is simple, only having three basic parts. It is compact, reliable and relatively inexpensive to manufacture.

Whereas the preferred form of the invention has been shown and described herein, it should be realized that there may be many modifications, substitutions and alterations thereto.

The embodiments of the invention in which an exclusive property or privilege is claimed are defined as follows:

1. In a holder for an electrical connector having a cylindrical body and an axially-extending key on the exterior thereof, a bracket for use in attaching the holder to a support, an opening in said bracket of a size and shape to receive the cylindrical body and key, a coil spring attached to said bracket and coaxially aligned with said opening, a cap held by said coiled spring and positioned to cover the end of an inserted electrical connector cylindrical body, and locking means on said bracket cooperating with said key to hold an electrical connector cylindrical body within the holder.

2. The structure of claim 1 further characterized by and including locking tabs integral with said bracket and adjacent said opening for holding said spring to said bracket.

3. The structure of claim 1 further characterized in that said opening includes a keyway of a size and shape to receive said key, and pilot members extending outwardly from said bracket adjacent said keyway for guiding an inserted connector body, said pilot members functioning as said locking means.

4. The structure of claim 1 further characterized in that said cap is positioned within said spring.

5. The structure of claim 4 further characterized in that said cap is generally flat, with an outer flange extending toward said bracket.

6. The structure of claim 5 further characterized in that said cap has a button with a spring coil of reduced diameter encircling said button to attach said cap to said spring.

* * * * *